US010662622B2

(12) United States Patent
Endo

(10) Patent No.: US 10,662,622 B2
(45) Date of Patent: May 26, 2020

(54) WORKING MACHINE

(71) Applicant: KOBELCO CONSTRUCTION MACHINERY CO., LTD., Hiroshima-shi (JP)

(72) Inventor: Kazuomi Endo, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 91 days.

(21) Appl. No.: 16/143,667

(22) Filed: Sep. 27, 2018

(65) Prior Publication Data

US 2019/0127957 A1 May 2, 2019

(30) Foreign Application Priority Data

Oct. 27, 2017 (JP) ..... 2017-207893

(51) Int. Cl.
*E02F 3/43* (2006.01)
*E02F 9/22* (2006.01)
(Continued)

(52) U.S. Cl.
CPC ..... *E02F 9/2235* (2013.01); *E02F 3/43* (2013.01); *E02F 3/963* (2013.01); *E02F 9/0858* (2013.01);
(Continued)

(58) Field of Classification Search
None
See application file for complete search history.

(56) References Cited

U.S. PATENT DOCUMENTS 2,741,601 A * 4/1956 MacCready, Jr. ..... A01G 15/00 239/14.1
3,263,141 A * 7/1966 Nicola ..... G08C 15/12 318/16

(Continued)

FOREIGN PATENT DOCUMENTS

EP 3 239 409 A1 11/2017
JP 10-237904 9/1998
KR 10-2010-0074557 A 7/2010

OTHER PUBLICATIONS

Extended European Search Report dated Apr. 4, 2019 in Patent Application No. 18197906.3, 7 pages.

*Primary Examiner* — Shelly Chen
(74) *Attorney, Agent, or Firm* — Oblon, McClelland, Maier & Neustadt, L.L.P.

(57) ABSTRACT

Provided is a working machine having an expanded range of a working device posture which permits information on an attachment of the working device to be transmitted from the attachment to a machine body through wireless communication. The working machine includes: a transmitter disposed in the attachment so as to be displaced together with the attachment relatively to the machine body and configured to send an information signal containing information on the attachment; a receiver disposed in the machine body and configured to receive the information signal; a controller which acquires information on the attachment based on the information signal received by the receiver; and a relay device disposed in the working device main body to receive the information signal sent by the transmitter and transmit the information signal to a position at which the information signal can be received by the receiver.

5 Claims, 4 Drawing Sheets

(51) Int. Cl.

| | |
|---|---|
| ***E02F 9/26*** | (2006.01) |
| ***E02F 9/20*** | (2006.01) |
| ***E02F 3/96*** | (2006.01) |
| ***E02F 9/08*** | (2006.01) |
| *G07C 5/00* | (2006.01) |

(52) U.S. Cl.
CPC ..... *E02F 9/2025* (2013.01); *E02F 9/2029* (2013.01); *E02F 9/264* (2013.01); *E02F 9/265* (2013.01); *E02F 9/2037* (2013.01); *E02F 9/2282* (2013.01); *G07C 5/008* (2013.01)

(56) References Cited

U.S. PATENT DOCUMENTS 3,408,546 A * 10/1968 Deliban ..... B66C 13/40 318/16
6,119,054 A 9/2000 Miki et al.
6,779,469 B1 * 8/2004 Weaver ..... A01C 7/105 111/170
8,849,186 B2 * 9/2014 Gore ..... H04B 1/525 455/7
8,972,094 B2 * 3/2015 Itoi ..... E02F 9/2054 340/438
10,019,007 B2 * 7/2018 Sakai ..... G05D 1/0088
10,416,646 B2 * 9/2019 Graves ..... G06T 7/90
2007/0040353 A1 * 2/2007 Dallaire ..... B60Q 1/305 280/476.1
2009/0198409 A1 8/2009 Rector et al.
2010/0291865 A1 * 11/2010 Gore ..... H04B 1/525 455/7
2014/0297091 A1 * 10/2014 Itoi ..... E02F 9/2054 701/24
2017/0220042 A1 * 8/2017 Sakai ..... E21F 13/00
2017/0225616 A1 * 8/2017 Tolliver ..... B60Q 9/00
2018/0136624 A1 * 5/2018 Graves ..... G06T 7/50

* cited by examiner

WORKING MACHINE

TECHNICAL FIELD

The present invention relates to a working machine equipped with a working device including a detachable attachment.

BACKGROUND ART

There is conventionally known a working machine such as a hydraulic excavator equipped with a working device. Some of the working devices include a working device main body, and various working attachments detachable from the working device main body, such as a breaker, a nibbler, a bucket, or the like, wherein the suitable attachment for a purpose is selected to be attached to the working device main body, which enables various works to be executed.

The working attachments have respective operation conditions different from each other for each kind of the working attachment. Hence, in such a working machine, the kind of a working attachment attached to a working device main body has to be appropriately grasped and the working attachment has to be operated under a condition suitable for the working attachment.

Unexamined Japanese Patent Publication No. H10-237904 discloses a construction machine capable of transmitting information on a working attachment from the working attachment to a machine body through wireless communication. The construction machine includes a transmitter provided in the working attachment and capable of transmitting an information signal containing information on the working attachment, and a controller provided in a machine body of the construction machine to receive the information signal to grasp the kind of the working attachment.

However, such a construction machine as described above, involving information transmission from a transmitter disposed in a working attachment to a controller disposed in a machine body through wireless communication, may have difficulty in the above information transmission depending on the relative positions of the working attachment and the controller, in other words, depending on the posture of the working device. The information transmission from a transmitter to a controller may be rendered difficult, for example, by such an posture of a working machine that the controller is so far away from the transmitter as to be located outside the communicable area of the transmitter or that a structure (e.g. an arm which supports a working attachment, and the like) such as a working device is interposed between the transmitter and the controller to prevent them from communicating information from the transmitter to the controller.

SUMMARY OF INVENTION

An object of the present invention is to provide a working machine including a machine body and a working device which includes a detachable attachment, the working device configured to displace the attachment relatively to the machine body, the working machine being capable of transmitting information on the attachment from the attachment to the machine body through wireless communication and having an expanded range of a transmission permissive posture of the working device, the transmission permissive posture being a posture which permits the information to be transmitted.

Provided is a working machine including: a machine body; a working device which includes a working device main body mounted on the machine body and an attachment detachable from the working device main body, the working device being operable to displace the attachment relatively to the machine body; a transmitter disposed in the attachment so as to be displaced together with the attachment relatively to the machine body and configured to send an information signal containing information on the attachment; a receiver disposed in the machine body and being capable of receiving the information signal; a controller which acquires information on the attachment based on the information signal received by the receiver; and a relay device disposed in the working device main body to receive the information signal sent by the transmitter and to transmit the information signal to a position at which the information signal can be received by the receiver.

DESCRIPTION OF EMBODIMENTS

Below will be specifically described an embodiment of the present invention with reference to the accompanying drawings.

Figure 1:
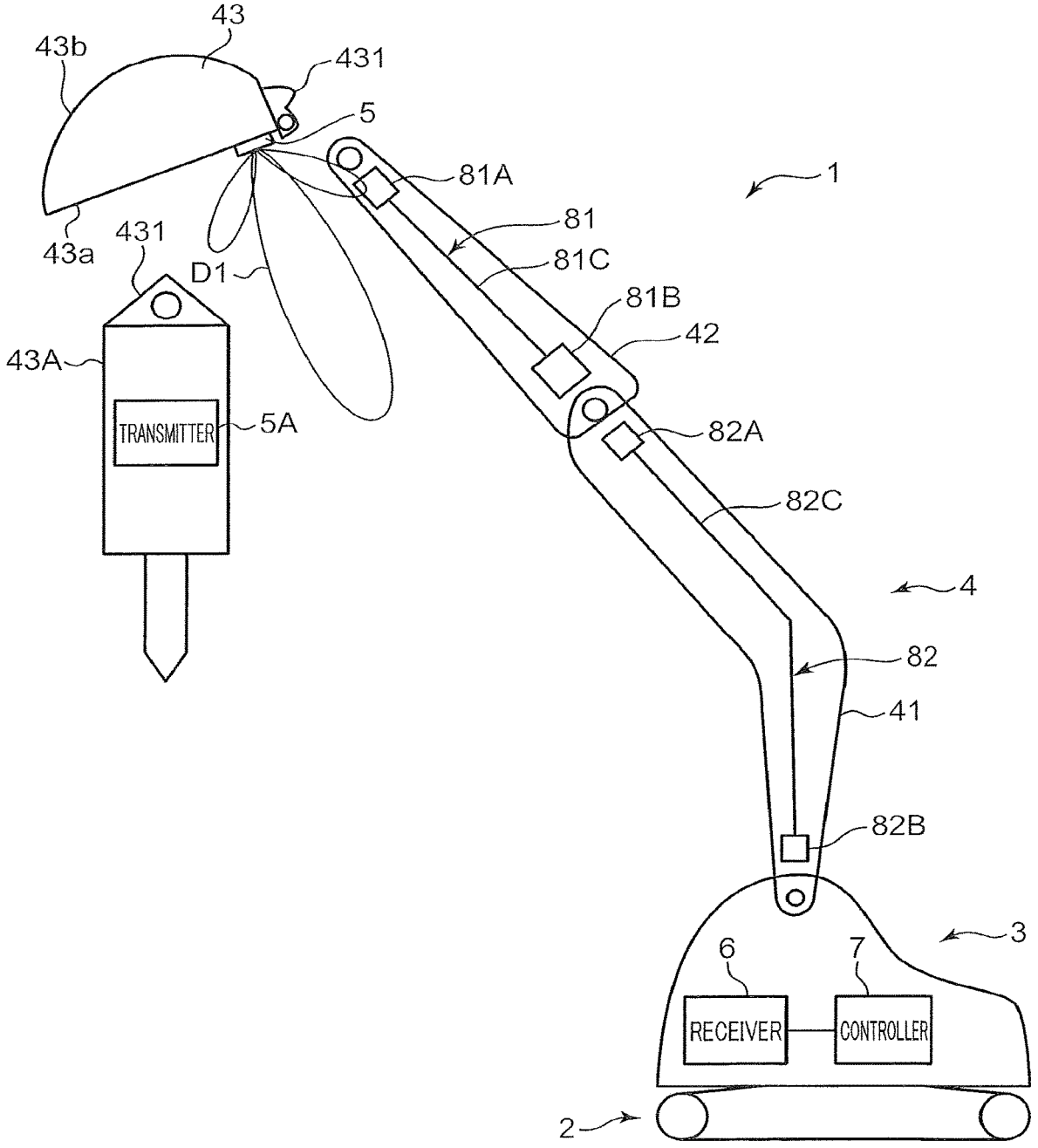
FIG. 1 is a configuration view of a working machine according to an embodiment of the present invention.

FIG. 1 shows a working machine 1 according to an embodiment of the present invention. The working machine 1 is a hydraulic excavator. The working machine according to the present invention, however, may be one other than a hydraulic excavator, for example, a hydraulic crane.

The working machine 1 includes a crawler type of lower travelling body 2, an upper slewing body 3 disposed on the lower travelling body 2 so as to be slewable, and a working device 4 mounted on the upper slewing body 3. The lower travelling body 2 and the upper slewing body 3 constitute a machine body of the working machine 1.

The working device 4 includes a boom 41 and an arm 42 as a working device main body, and an attachment 43. The boom 41 is mounted on the upper slewing body 3 so as to be raisable and lowerable. The arm 42 is rotatably coupled to the front end portion of the boom 41. Specifically, the boom 41 and the arm 42 are intercoupled through a displacement-allowing intercoupling portion 40 so as to be displacable relatively to each other. The boom 41 and the arm 42 correspond to a plurality of split movable members which are aligned sequentially from the machine body to the attachment. The attachment 43 is mounted on a front end portion of the arm 42 so as to be rotatable relatively to the arm 42.

The working device 4 further includes a plurality of not-graphically-shown actuators. The plurality of actuators includes an actuator to raise and lower the boom 41 relatively to the upper slewing body 3, an actuator to rotate the arm 42 relatively to the boom 41, and an actuator to displace the attachment 43 relatively to the arm 42.

The working device 4 changes the angle between the boom 41 and the upper slewing body 3, the angle between the boom 41 and the arm 42, and the angle between the arm 42 and the attachment 43, according to an operation given by an operator, thereby changing the posture of the working device 4. The working device 4 is, thus, operable to displace the attachment 43 relatively to the upper slewing body 3.

The attachment 43 includes an attachment portion 431. The attachment portion 431 is a portion to be detachably attached to a front end of the arm 42. The attachment 43 shown in FIG. 1 is, for example, a bucket. However, the attachment according to the invention only has to be detachably attached to the working device main body, being allowed to be, for example, a breaker or a nibbler. In place of the attachment 43 may be attached, for example, an attachment 43A shown in FIG. 1. The attachment 43A is, for example, a breaker. The attachment 43A also has an attachment portion 431 detachably attached to the front end of the arm 42 as well. The working machine 1, thus, allows the attachment 43 formed of, for example, a bucket, and the attachment 43A formed of, for example, a breaker, to be exchanged from each other.

The working machine 1 further includes a transmitter 5 and a transmitter 5A. The transmitters 5 and 5A are disposed in the attachment 43 and the attachment 43A, respectively. The transmitter 5 disposed in the attachment 43 sends an information signal containing identification information for identifying the attachment 43. The transmitter 5A disposed in the attachment 43A sends an information signal containing identification information for identifying the attachment 43A.

In FIG. 1, the transmitter 5 is disposed at a position on a surface 43*a* of the attachment 43, the surface 43*a* being one to face the ground during excavation work, the position being close to the rear end (the position close to the arm 42). The position is, however, not limited. The transmitter 5 may be disposed at either a position on the surface 43*a* closer to the front end or an appropriate position on a bottom surface 43*b* of the attachment 43.

Figure 2:
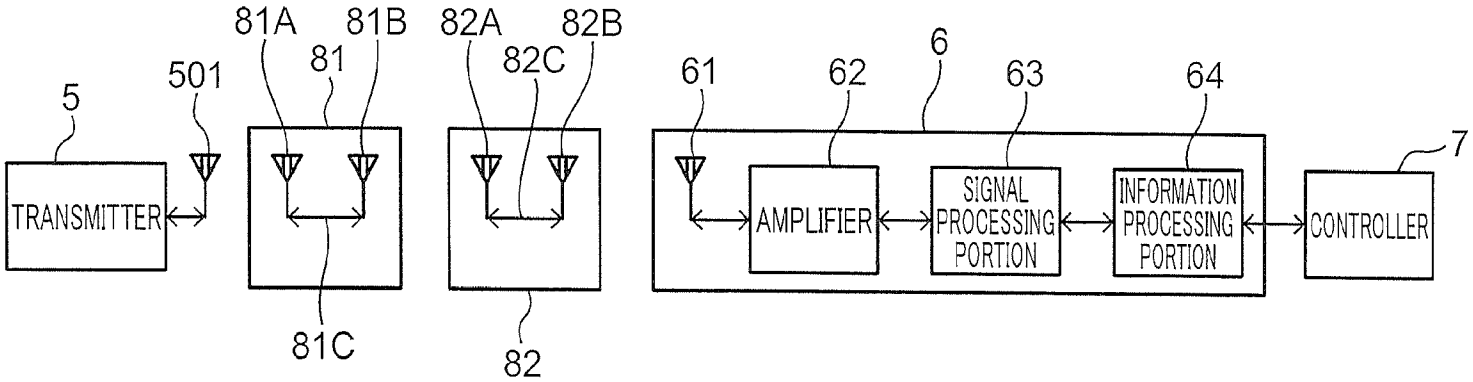
FIG. 2 is a block diagram showing components in charge of communication in the working machine shown in FIG. 1.

FIG. 1 shows a communicable area D1 of the transmitter 5. The communicable area D1 is an area which an information signal sent by the transmitter 5 can reach. The transmitter 5 has an antenna 501 as shown in FIG. 2, and the communicable area D1 is determined by the directional characteristics of the antenna 501 and the output from the transmitter 5. The communicable area D1 shown in FIG. 1 includes a main lobe extending in a normal-line direction normal to a radiation plane of the transmitter 5, and a plurality of side lobes extending in a direction diagonal to the normal-line direction, the main lobe being located between the side lobes. The antenna 501 may have directional characteristics of non-direction.

The working machine 1 further includes a receiver 6 and a controller 7 disposed inside the upper slewing body 3. The receiver 6 receives an information signal sent by the transmitter 5. The controller 7 plays a role in entire control of the working machine 1.

Inside the upper slewing body 3 are further provided an engine as a power source, a hydraulic pump driven by the engine, a control valve to adjust a flow rate of hydraulic oil to be supplied to the actuator from the hydraulic pump, and an operation lever to which an operation is applied by an operator. The controller 7 causes the control valve to be opened according to an operation amount which is the extent of operation applied to the operation lever for actuating the working device 4, thereby controlling the flow rate of hydraulic oil to be supplied to each of the actuators from the hydraulic pump. This control brings the working device 4 into the posture corresponding to the operation amount.

FIG. 2 is a block diagram showing components in charge of communication in the working machine 1 shown in FIG. 1. The transmitter 5 is comprised of, for example, an IC tag. The transmitter 5 outputs an information signal including identification information for identifying the attachment 43 from the antenna 501 to an external space. In addition to the antenna 501, the transmitter 5 includes a memory which stores the identification information and an electronic circuit. The electronic circuit reads the identification information from the memory and modifies transmission data containing the read identification information to generate an information signal and output the information signal from the antenna 501.

The IC tag may be either an active type IC tag which is also referred to as a radio frequency identifier (RFID) tag using a contained battery as a power source or a passive type IC tag using radio waves from an IC tag reader as a power source. Some of the active type IC tags are configured to convert environmental energy such as vibration or sunlight into electric power to use it as a power source.

Since the working device 4 is included in a construction machine such as a hydraulic excavator, the IC tag mounted thereon is liable to be vibrated, and is generally used under sunlight. In view of these circumstances, the present embodiment adopts, as the transmitter 5, an active type IC tag which uses electricity obtained from environmental energy as a power source. The present invention is, however, not limited thereto. The transmitter according to the present invention may be a passive type IC tag or an active type IC tag including an ordinary battery. Besides, the transmitter 5 according to the present embodiment may be either one configured to send an information signal containing identification information at a fixed sampling interval or one configured to send an information signal containing identification information in response to a request from the receiver 6.

As the identification information can be adopted information containing at least one of information indicative of classification of the attachment 43, information indicative of the manufacturer, a serial number, and a product number. The information indicative of classification is information indicative of the kind of the attachment 43 (e.g. a bucket, a breaker).

The receiver 6 is comprised of, for example, an IC tag reader. In detail, the receiver 6 includes an antenna 61, an amplifier 62, a signal processing portion 63, and an information processing portion 64. The antenna 61 receives the information signal sent by the transmitter 5. The amplifier 62 amplifies the received information signal. The signal processing portion 63 demodulates the amplified information signal to extract transmission data. The information processing portion 64 decodes the extracted transmission data to acquire the identification information and inputs the identification information to the controller 7.

The identification information input to the controller 7 is accumulated as log data in the memory of the controller 7, being correlated with reception time. The log data accumulated in the memory is correlated with identification information of the working machine 1 at an interval of a predetermined unit time (e.g. one day) and is transmitted to a server (not shown) via a communication network. The server having received the log data accumulates the log data in a memory of the server itself. The server receives such log data from a plurality of working machines to accumulate the log data in the memory. This enables a manager to manage which attachment 43 is or was attached in each working machine 1.

Besides, the controller 7 recognizes the currently attached attachment 43 based on the identification information sent by the transmitter 5, and executes control of the working machine 1 according to the recognized attachment 43.

The controller 7 is comprised of, for example, a computer including a processor such as CPU and a memory. The controller 7 is connected to the receiver 6 through wires.

In the working machine 1, some of the postures of the working device 4 may hinder the receiver 6 from directly receiving an information signal sent by the transmitter 5. In view of this, the working machine 1 further includes a relay device 8. The relay device 8 conducts a relay of transmission of the information signal from the transmitter 5 to the receiver 6, thereby expanding the range of transmission permissive posture of the working device 4, the transmission permissive posture being a posture which permits the transmission.

Below will be described the relay device 8 with reference to FIGS. 1 and 2.

The relay device 8 receives the information signal sent by the transmitter 5 and transmits the information signal to a position at which the information signal can be received by the receiver 6. The relay device 8 is disposed in the working device main body, that is, a part constituted mainly by the arm 42 and the boom 41.

The relay device 8 includes a plurality of (two in the present embodiment) relay units 81 and 82. The relay device 8 performs transmission of an information signal from the transmitter 5 to the receiver 6 through transmission and reception of an information signal conducted by the plurality of relay units 81 and 82.

The plurality of relay units 81 and 82 include the relay unit 81 as a transmission-side relay unit and the relay unit 82 as a reception-side relay unit. In the following, these relay units 81 and 82 will be described.

The relay unit 81 includes a relay reception antenna 81A, a relay transmission antenna 81B, and a transmission line 81C. The relay reception antenna 81A receives an information signal sent by the transmitter 5. The relay transmission antenna 81B sends the information signal received by the relay reception antenna 81A. Each of the relay reception antenna 81A and the relay transmission antenna 81B is, for example, a linear antenna.

The transmission line 81C interconnects the relay reception antenna 81A and the relay transmission antenna 81B so as to transmit the information signal received by the relay reception antenna 81A to the relay transmission antenna 81B. The specific configuration of the transmission line 81C is not particularly limited under the condition that the configuration enables transmission of an information signal to be performed via wires. The transmission line 81C is, for example, an electric wire.

The relay unit 81 is disposed in the arm 42. In the example shown in FIG. 1, the relay unit 81 is disposed on a side surface of the arm 42. The relay unit 81, however, also may be disposed, for example, on a bottom surface of the arm 42, the bottom surface being one to be opposed to the ground.

The relay reception antenna 81A is disposed in one end portion of opposite end portions of the arm 42, the one end portion being closer to the transmitter 5 than the other end portion, so as to be able to directly receive the information signal sent by the transmitter 5. This allows transmission of an information signal to be done wirelessly from the transmitter 5 to the relay unit 81.

The relay transmission antenna 81B is disposed in the other end portion of the opposite end portions of the arm 42, that is, the end portion farther from the transmitter 5 than the one end portion of the arm 42.

The transmission line 81C is disposed along the arm 42 so as to interconnect the relay reception antenna 81A and the relay transmission antenna 81B. This enables wired transmission of an information signal from the relay reception antenna 81A to the relay transmission antenna 81B, that is, transmission via the transmission line 81C, to be done.

The relay unit 82 includes a relay reception antenna 82A, a relay transmission antenna 82B, and a transmission line 82C. The relay reception antenna 82A receives an information signal sent from the relay transmission antenna 81B of the relay unit 81. The relay transmission antenna 82B sends the information signal received by the relay reception antenna 82A. Each of the relay reception antenna 82A and the relay transmission antenna 82B is, for example, a linear antenna, similarly to the relay reception antenna 81A and the relay transmission antenna 82B.

The transmission line 82C interconnects the relay reception antenna 82A and the relay transmission antenna 82B so as to transmit the information signal received by the relay reception antenna 82A to the relay transmission antenna 82B. A specific configuration of the transmission line 82C is not particularly limited under the condition that the configuration enables transmission of an information signal to be done via wires. The transmission line 82C is, for example, an electric wire similarly to the transmission line 81C.

The relay unit 82 is disposed in the boom 41. In the example shown in FIG. 1, the relay unit 82 is disposed on a side surface of the boom 41. The relay unit 82, however, may be disposed, for example, on a bottom surface of the boom 41, the bottom surface being one to be opposed to the ground.

The relay reception antenna 82A is disposed in one end portion of opposite end portions of the boom 41, the one end portion being closer to the relay unit 81 than the other end portion, so as to be able to directly receive an information signal sent from the relay transmission antenna 81B. This enables transmission of an information signal to be done wirelessly from the relay unit 81 to the relay unit 82.

Thus, in the present embodiment, the relay unit 81 corresponds to a first relay unit and the relay unit 82 corresponds to a second relay unit; the arm 42 in which the relay unit 81 is disposed corresponds to a first split movable member, and the boom 41 in which the relay unit 82 is disposed corresponds to a second split movable member.

The relay transmission antenna 82B is disposed in the other end portion of the opposite end portions of the boom 41, the other end portion being closer to the receiver 6 than the one end portion of the boom 41, to allow the receiver 6 to directly receive the information signal sent from the relay transmission antenna 82B. This enables transmission of an information signal to be done wirelessly from the relay unit 82 to the receiver 6.

The transmission line 82C is disposed along the boom 41 so as to interconnect the relay reception antenna 82A and the relay transmission antenna 82B. This enables transmission of an information signal from the relay reception antenna 82A to the relay transmission antenna 82B via wires, that is, via the transmission line 82C.

Figure 3:
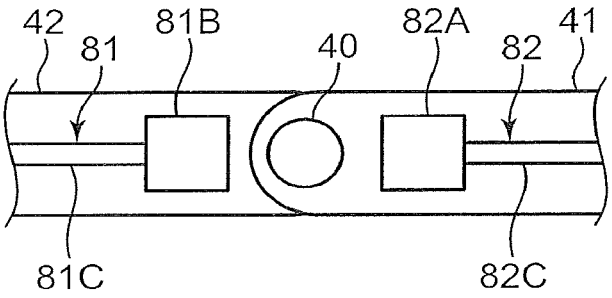
FIG. 3 is a schematic enlarged configuration view to show a intercoupling portion of the working device at which an arm and a boom are intercoupled.

According to the above disposition of the relay unit 81 and the relay unit 82, the displacement-allowing intercoupling portion 40 is located between the relay transmission antenna 81B and the relay reception antenna 82A as shown in FIG. 3, the displacement-allowing intercoupling portion intercoupling the arm 42 and the boom 41 so as to allow the arm 42 and the boom 41 to be displaced relatively to each other. In other words, the transmission of an information signal from the relay transmission antenna 81B to the relay reception antenna 82A is conducted across the displacement-allowing intercoupling portion 40.

The relay device 8 conducts relay which enables the transmission of an information signal to be done from the transmitter 5 to the receiver 6. This allows the range of the transmission permissive posture of the working device 4 to be expanded as compared with a conventional working machine capable of only direct transmission of an information signal from a transmitter to a receiver, the transmission permissive posture being one permitting the transmission of the information signal to be done from the transmitter 5 to the receiver 6.

The plurality of relay units 81 and 82 are disposed in series to conduct, in this order, serial transmission of an information signal from the transmitter 5 to the receiver 6. This enables the range of the position of the working device 4 to be further expanded.

The transmission line 80C of each of the relay units 81 and 82 is disposed without crossing over the displacement-allowing intercoupling portion 40, thus allowing the plurality of relay units 81 and 82 to conduct the relay for transmitting an information signal from the transmitter 5 to the receiver 6 without hindering the movement at the displacement-allowing intercoupling portion 40.

Besides, the working machine 1 allows respective lengths of the transmission lines 81C and 82C to be large, the transmission lines 81C and 82C conducting wired communication in the relay unit 81 and the relay unit 82, while allowing the distance from the relay transmission antenna 82B to the relay reception antenna 82A to be small. This enables reliable relay to be conducted for transmission of an information signal across the displacement-allowing intercoupling portion 40 while saving electricity consumption of each of the relay unit 81 and the relay unit 82.

Figure 4:
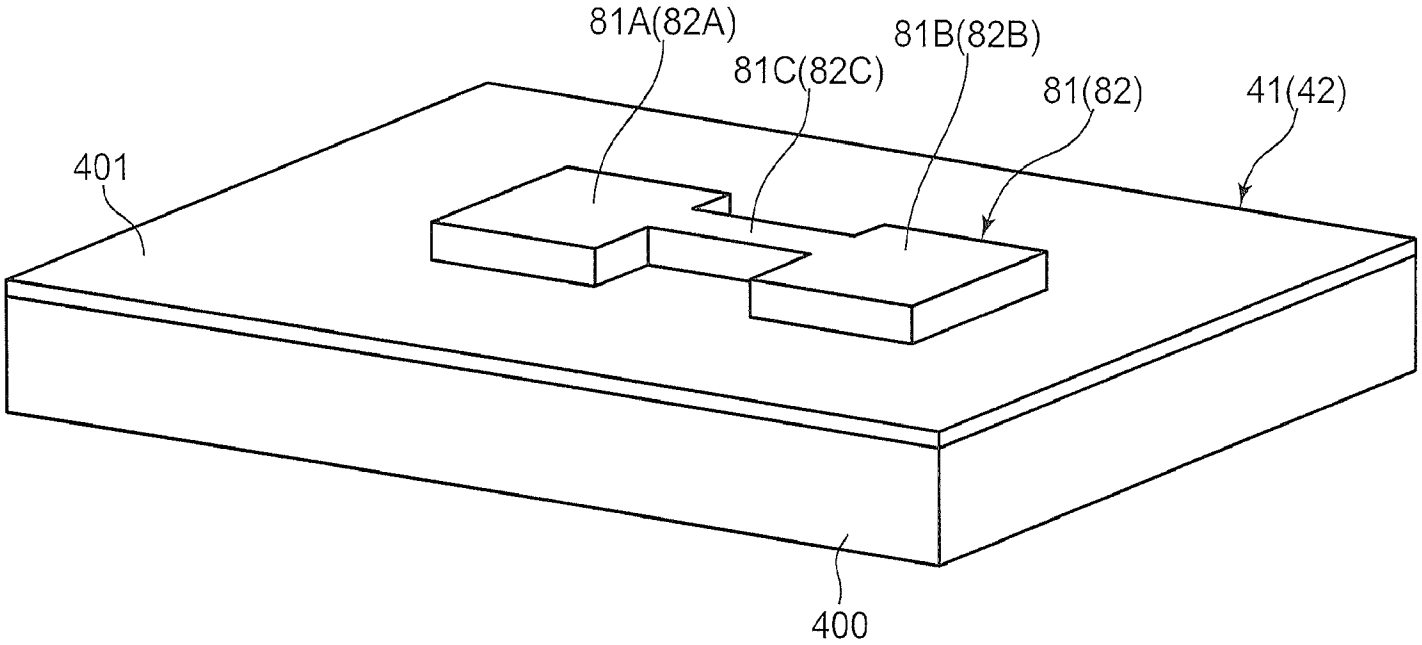
FIG. 4 is a perspective view showing a modification of a relay unit.

FIG. 4 shows a modification of the embodiment. The modification also includes a relay reception antenna 8A, a relay transmission antenna 8B, and a transmission line 8C similarly to the embodiment but all of them are formed in the same plane.

According to the modification shown in FIG. 4, the relay reception antenna 8A, the relay transmission antenna 8B, and the transmission line 8C are formed on a front surface of the working device main body. Specifically, the relay reception antenna 8A, the relay transmission antenna 8B, and the transmission line 8C included in the relay unit 81 are all formed on a surface of the arm 42, while the relay reception antenna 8A, the relay transmission antenna 8B, and the transmission line 8C included in the relay unit 82 are all formed on a surface of the boom 41.

The surface of each of the arm 42 and the boom 41 is formed of a covering film 401 which covers the surface of a metal material 400 forming a base body of each of the arm 42 and the boom 41. The covering film 401 has a high insulation property (i.e. a high dielectric constant). The covering film 401 is, for example, a coating applied on the surface of the metal material 400. The covering film 401 has a thickness smaller than one-tenth a wavelength of an electromagnetic wave.

Each of the relay unit 81 and the relay unit 82 according to the modification has a microstrip configuration. Specifically, each of the relay reception antenna 8A and the relay transmission antenna 8B is a planar antenna, and the transmission line 8C is a conductive film.

The modification allows each of the relay reception antenna 8A, the relay transmission antenna 8B, and the transmission line 8C to have a considerably small thickness, thereby providing the relay reception antenna 8A, the relay transmission antenna 8B, and the transmission line 8C with respective considerably small heights from the surface of the arm 42 or the boom 41. This allows both the possibility of break of the transmission line 8C and the possibility of damages of the relay reception antenna 8A and the relay transmission antenna 8B during working by the working machine 1 to be reduced.

Besides, directly formed on the surface of the arm 42 or the boom 41, the relay reception antenna 8A, the relay transmission antenna 8B, and the transmission line 8C have respective reduced protrusions from the surface of the arm 42 or the boom 41 as compared with, for example, the case where the relay reception antenna 8A, the relay transmission antenna 8B, and the transmission line 8C are separately mounted on the surface of the arm 42 or the boom 41.

The embodiment and the modification thereof are illustrative and do not limit the present invention.

For example, the attachment according to the present invention is not limited to one disposed at a front end of a working device, such as a bucket or a nibbler. For example, in the case where an arm is disposed detachably from a boom, there can exist an applicable mode where not only a working attachment detachable from an arm, such as a bucket or a nibbler, but also at least the arm itself serves as the attachment according to the present invention.

There can also exist another mode including a boom and an arm which are intercoupled wherein the boom corresponds to the attachment according to the present invention while at least the arm corresponds to the working device main body according to the present invention. In other words, the working device main body according to the present invention may be either directly mounted on the machine body or mounted on the machine body through other member (e.g. an attachment). In summary, the working device of the present invention only has to include a working device main body and an attachment displacable relatively to a machine body and detachable from the working device main body.

The boom according to the present invention may be constituted by a plurality of split booms which are members independent of each other. In the case where the plurality of split booms include three or more ones disposed in series, the interposed split boom between respective split booms at opposite ends (i.e., an inserted boom) can serve as the attachment according to the present invention.

The working machine according to the present invention may be a working machine except for a hydraulic excavator, for example, a crane. The crane is, for example, a tower crane. A tower crane includes, for example, a crawler type travelling crane main body (machine body) and an attachment such as a tower, a tower jib, or the like mounted thereon. Specifically, the tower is mounted on a front portion of the crane main body so as to be raisable and lowerable, configured to be operated in the raised and lowered direction by use of a tower up-down rope. The tower jib is mounted on a front end of the tower so as to go up and down and is operated in an up-down direction by a jib up-down rope.

The relay device according to the present invention may include a single relay unit. The single relay unit, when having a relay reception antenna which directly receives an information signal sent by a transmitter and a relay transmission antenna which sends the received information signal to make a receiver receive the information signal, is also capable of relay the information signal.

The present invention permits the number of a plurality of split movable members (the arm 42 and the boom 41 in the above embodiment) forming the working device main body and the number of relay units to be not coincident with each other. For example, in the case where the plurality of split movable members include a long split movable member, two or more relay units can be disposed in the long split movable member.

The plurality of relay units according to the present invention may further include at least one relay unit (other relay unit) in addition to a transmission-side relay unit and a reception-side relay unit. The at least one other relay unit is preferably located between the transmission-side relay unit and the-reception-side relay unit and disposed so as to be able to relay transmission of an information signal from the transmission-side relay unit to the reception-side relay unit.

The plurality of relay units according to the present invention may include three or more relay units disposed in series. Among the plurality of relay units, the relay unit other than the two relay units positioned at opposite ends function both as a first relay unit which sends an information signal to a relay unit positioned downstream of the first relay unit and as a second relay unit which receives an information signal sent by the relay unit positioned upstream of the second relay unit.

In the case where the working machine according to the present invention includes a plurality of relay units, the plurality of relay units may be disposed in parallel to each other. Specifically, the plurality of relay units may be disposed so as to form a plurality of information signal transmission lines in parallel to each other between a transmitter and a receiver. In this case, an information signal sent by the transmitter is transmitted to the receiver via any of the relay units disposed in parallel. Each of the transmission lines may be realized by a single relay unit or by a plurality of relay units disposed in series.

The relay reception antenna, the relay transmission antenna, and the transmission line according to the present invention may be formed on a surface of a common plate-shaped member. This case enables the relay reception antenna, the relay transmission antenna, and the transmission line to be disposed in the working device main body by mounting the plate-shaped member on the working device main body.

As described in the foregoing, there is provided a working machine including a machine body and a working device which includes a detachable attachment, the working device configured to displace the attachment relatively to the machine body, the working machine being capable of transmitting information on the attachment from the attachment to the machine body through wireless communication and having an expanded range of a transmission permissive posture of the working device, the transmission permissive posture being a posture which permits the information to be transmitted. The working machine includes: a machine body; a working device which includes a working device main body mounted on the machine body and an attachment detachable from the working device main body, the working device being operable to displace the attachment relatively to the machine body; a transmitter disposed in the attachment so as to be displaced together with the attachment relatively to the machine body and configured to send an information signal containing information on the attachment; a receiver disposed in the machine body and being capable of receiving the information signal; a controller which acquires information on the attachment based on the information signal received by the receiver; and a relay device disposed in the working device main body to receive the information signal sent by the transmitter and to transmit the information signal to a position at which the information signal can be received by the receiver.

The above relay device, configured to conduct a relay which allows transmission of an information signal to be done from a transmitter disposed in an attachment to a receiver provided in a machine body at a position where the relay device is provided in the working device main body, enables the range of the transmission permissive posture of the working device to be expanded, the transmission permissive posture being one permitting the information to be transmitted from the transmitter to the receiver, as compared with a conventional working machine capable of only direct transmission of an information signal from a transmitter to a receiver.

The relay device preferably includes at least one relay unit, the at least one relay unit including a relay reception antenna capable of receiving the information signal, a relay transmission antenna capable of sending the information signal, and a transmission line which interconnects the relay reception antenna and the relay transmission antenna so as to transmit the information signal received by the relay reception antenna to the relay transmission antenna, the at least one relay unit thus being configured to receive the information signal and send the received information signal to allow the information signal to be transmitted from the transmitter to the receiver.

Furthermore, the at least one relay unit, when including a plurality of relay units, enables the range of the transmission permissive posture of the working device to be further expanded. Specifically, the plurality of relay units suitably include a transmission-side relay unit located closest to the transmitter of the plurality of relay units, the transmission-side relay unit being disposed at such a position that the information signal sent by the transmitter can be directly received by the relay reception antenna of the transmission-side relay unit, and a reception-side relay unit located closest to the receiver of the plurality of relay units, the reception-side relay unit being disposed at such a position that the information signal sent from the relay transmission antenna of the reception-side relay unit is directly received by the receiver, the information signal sent from the relay transmission antenna of the transmission-side relay unit being transmitted to the relay reception antenna of the reception-side relay unit directly or via other relay unit.

Because of including the transmission-side relay unit and the reception-side relay unit, the relay device according to this mode enables serial transmission of an information signal to be done from a transmitter to a receiver via at least two relay units, which enables the range of the transmission permissive range of the working device to be further expanded.

In the case where the working device main body includes a plurality of split movable members aligned sequentially from the machine body to the attachment and the split movable members adjacent to each other among the plurality of split movable members are intercoupled through a displacement-allowing intercoupling portion so as to be able to be displaced relatively to each other, the plurality of relay units preferably include a first relay unit and a second relay unit, the first relay unit and the second relay unit being mounted on a first split movable member and a second split movable member adjacent to the first split movable member, respectively, the first split movable member and the second movable member being included in the plurality of split movable members, so as to allow the information signal sent from the relay transmission antenna of the first relay unit to be directly received by the relay reception antenna of the second relay unit. This disposition allows the transmission lines of the first and second relay units to be disposed without crossing over the displacement-allowing intercoupling portion, thereby enabling the plurality of relay units to relay the transmission of the information signal from the transmitter to the receiver without hindering movement at the displacement-allowing intercoupling portion.

More specifically, it is preferable that: the relay transmission antenna of the first relay unit is disposed at one end portion of opposite end portions of the first split movable member, the one end portion of the first split movable member being closer to the second split movable member than the other end portion of the opposite end portions of the first split movable member; the relay reception antenna of the first relay unit is disposed at the other end portion of the opposite end portions of the first split movable member, the other end portion being farther from the second split movable member than the one end portion of the opposite end portions of the first split movable member; the relay reception antenna of the second relay unit is disposed at one end portion of opposite end portions of the second split movable member, the one end portion of the second split movable member being closer to the first split movable member than the other end portion of the opposite end portions of the second split movable member; the relay transmission antenna of the second relay unit is disposed at the other end portion of the opposite end portions of the second split movable member, the other end portion of the second split movable member being farther from the first split movable member than the one end portion of the opposite end portions of the second split movable member; the transmission line of the first relay unit is disposed along the first split movable member so as to interconnect the relay transmission antenna and the relay reception antenna of the first relay unit; and the transmission line of the second relay unit is disposed along the second split movable member so as to interconnect the relay transmission antenna and the relay reception antenna of the second relay unit.

Such disposition of the first and second relay units allows the distance from the relay transmission antenna of the first relay unit to the relay reception antenna of the second relay unit to be reduced while allowing the length of a transmission line which conducts wired communication out of the transmission lines of the first and second relay units to be increased; this enables the first and second relay units to conduct reliable relay for transmission of the information signal across the displacement-allowing intercoupling portion while saving electricity consumption of each of the first and second relay units.

Preferably, the transmission line is a conductive film formed on a predetermined plane and each of the relay reception antenna and the relay transmission antenna is a planar antenna formed on the predetermined plane. The transmission line thus formed of a conductive film and each of the relay reception antenna and the relay transmission antenna each being a plane antenna have respective small thicknesses, which allows the transmission line, the relay reception antenna, and the relay transmission antenna to have respective small heights from the predetermined surface. This reduces the possibility of break of the transmission line and the possibility of damages of the relay reception antenna and/or the relay transmission antenna during working by the working machine.

Preferably, the predetermined plane is, for example, a surface of the working device main body. Thus forming the transmission line, the relay reception antenna, and the relay transmission antenna on the surface of the working device main body allows respective heights of the transmission line, the relay reception antenna, and the relay transmission antenna from the surface of the working device main body to be further reduced as compared with the case of mounting the transmission line, the relay reception antenna, and the relay transmission antenna on a member separate from the working device main body. This makes it possible to reliably avoid the break of the transmission line and damages of the relay reception antenna and/or the relay transmission antenna during working by the working machine.

This application is based on Japanese Patent application No. 2017-207893 filed in Japan Patent Office on Oct. 27, 2017, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A working machine comprising:

a machine body;

a working device which includes a working device main body mounted on the machine body and an attachment detachable from the working device main body, the working device being operable to displace the attachment relatively to the machine body;

a transmitter disposed in the attachment so as to be displaced together with the attachment relatively to the machine body and configured to send an information signal containing information on the attachment;

a receiver disposed in the machine body and being capable of receiving the information signal;

a controller which acquires information on the attachment based on the information signal received by the receiver; and a relay device disposed in the working device main body to receive the information signal sent by the transmitter and to transmit the information signal to a position at which the information signal can be received by the receiver, wherein the relay device includes at least one relay unit, the at least one relay unit including a relay reception antenna capable of receiving the information signal, a relay transmission antenna capable of sending the information signal, and a transmission line which interconnects the relay reception antenna and the relay transmission antenna so as to transmit the information signal received by the relay reception antenna to the relay transmission antenna, the at least one relay unit thus being configured to receive the information signal and send the received information signal to allow the information signal to be transmitted from the transmitter to the receiver, wherein the at least one relay unit includes a plurality of relay units, the plurality of relay units including: a transmission-side relay unit located closest to the transmitter of the plurality of relay units, the transmission-side relay unit being disposed at such a position that the information signal sent by the transmitter can be received by the relay reception antenna of the transmission-side relay unit, and a reception-side relay unit located closest to the receiver of the plurality of relay units, the reception-side relay unit being disposed at such a position that the information signal sent from the relay transmission antenna of the reception-side relay unit can be received by the receiver, the information signal sent from the relay transmission antenna of the transmission-side relay unit being transmitted to the relay reception antenna of the reception-side relay unit directly or via other relay unit.

2. The working machine according to claim 1, wherein: the working device main body includes a plurality of split movable members aligned sequentially from the machine body to the attachment, the split movable members adjacent to each other among the plurality of split movable members are intercoupled through a displacement-allowing intercoupling portion so as to be able to be displaced relatively to each other; the plurality of relay units include a first relay unit and a second relay unit, the first relay unit and the second relay unit being mounted on a first split movable member and a second split movable member adjacent to the first split movable member, respectively, the first split movable member and the second movable member being included in the plurality of split movable members, so as to allow the information signal sent from the relay transmission antenna of the first relay unit to be directly received by the relay reception antenna of the second relay unit.

3. The working machine according to claim 2, wherein: the relay transmission antenna of the first relay unit is disposed at one end portion of opposite end portions of the first split movable member, the one end portion of the first split movable member being closer to the second split movable member than the other end portion of the opposite end portions of the first split movable member; the relay reception antenna of the first relay unit is disposed at the other end portion of the opposite end portions of the first split movable member, the other end portion being farther from the second split movable member than the one end portion of the opposite end portions of the first split movable member; the relay reception antenna of the second relay unit is disposed at one end portion of opposite end portions of the second split movable member, the one end portion of the second split movable member being closer to the first split movable member than the other end portion of the opposite end portions of the second split movable member; the relay transmission antenna of the second relay unit is disposed at the other end portion of the opposite end portions of the second split movable member, the other end portion of the second split movable member being farther from the first split movable member than the one end portion of the opposite end portions of the second split movable member; the transmission line of the first relay unit is disposed along the first split movable member so as to interconnect the relay transmission antenna and the relay reception antenna of the first relay unit; and the transmission line of the second relay unit is disposed along the second split movable member so as to interconnect the relay transmission antenna and the relay reception antenna of the second relay unit.

4. The working machine according to claim 1, wherein the transmission line is a conductive film formed on a predetermined plane, and each of the relay reception antenna and the relay transmission antenna is a planar antenna formed on the predetermined plane.

5. The working machine according to claim 4, wherein the predetermined plane is a surface of the working device main body.

* * * * *